US007487609B2

(12) United States Patent
Nakamura et al.

(10) Patent No.: US 7,487,609 B2
(45) Date of Patent: Feb. 10, 2009

(54) HYDRAULIC CIRCUIT DEVICE OF HYDRAULIC WORKING MACHINE

(75) Inventors: Tsuyoshi Nakamura, Niihari-gun (JP); Tsukasa Toyooka, Higashiibaraki-gun (JP); Koji Ishikawa, Niihari-gun (JP); Masao Nishimura, Niihari-gun (JP)

(73) Assignee: Hitahi Construction Machinery Co., Ltd., Tokyo (JP)

( * ) Notice: Subject to any disclaimer, the term of this patent is extended or adjusted under 35 U.S.C. 154(b) by 368 days.

(21) Appl. No.: 10/494,447

(22) PCT Filed: Nov. 1, 2002

(86) PCT No.: PCT/JP02/11418

§ 371 (c)(1),
(2), (4) Date: Sep. 7, 2005

(87) PCT Pub. No.: WO03/040573

PCT Pub. Date: May 15, 2003

(65) Prior Publication Data

US 2006/0080955 A1 Apr. 20, 2006

(30) Foreign Application Priority Data

Nov. 5, 2001 (JP) ..... 2001-339621

(51) Int. Cl.
*E02F 5/02* (2006.01)

(52) U.S. Cl. ..... 37/348; 37/414; 414/699; 701/50

(58) Field of Classification Search ..... 37/348, 37/382, 414, 415; 172/5, 6, 9; 701/50; 414/699–701
See application file for complete search history.

(56) References Cited

U.S. PATENT DOCUMENTS

| | | | | | |
|---|---|---|---|---|---|
| 4,875,337 | A | * | 10/1989 | Sugiyama et al. | 60/421 |
| 5,062,350 | A | * | 11/1991 | Tanaka et al. | 91/448 |
| 5,065,326 | A | * | 11/1991 | Sahm | 701/50 |
| 5,189,940 | A | * | 3/1993 | Hosseini et al. | 91/361 |
| 5,826,666 | A | * | 10/1998 | Tozawa et al. | 172/7 |
| 5,899,008 | A | * | 5/1999 | Cobo et al. | 37/348 |
| 5,940,997 | A | * | 8/1999 | Toyooka et al. | 37/411 |
| 5,975,214 | A | * | 11/1999 | Okamura et al. | 172/2 |
| 6,047,228 | A | * | 4/2000 | Stone et al. | 701/50 |
| 6,050,090 | A | * | 4/2000 | Tohji | 60/421 |

FOREIGN PATENT DOCUMENTS

| | | |
|---|---|---|
| JP | 58-195641 | 11/1983 |
| JP | 9-151487 | 6/1997 |
| JP | 9-296803 | 11/1997 |
| JP | 11-82416 | 3/1999 |

* cited by examiner

*Primary Examiner*—Thomas A Beach
*Assistant Examiner*—Matthew R Buck
(74) *Attorney, Agent, or Firm*—Crowell & Moring LLP

(57) ABSTRACT

To permit smooth performance of both of an operation requiring a high pressure and an operation desired to produce a pressure at a suppressed level, a shuttle block positioned between pilot operating units and flow control valves and pump regulators is arranged in association with shuttle valves, which select maximum pressures of groups of operation signal pressures produced by the pilot operating units, respectively, and at least one of the plural groups of operation signals, and is constructed to include hydraulic selector valves and a boom-lowering, hydraulic selector valve that are operable in particular ways.

1 Claim, 9 Drawing Sheets

HYDRAULIC CIRCUIT DEVICE OF HYDRAULIC WORKING MACHINE

TECHNICAL FIELD

The present invention relates to a hydraulic circuit system for a hydraulic working machine such as a hydraulic excavator, and more particularly to a hydraulic circuit system for hydraulic working machine in which the maximum pressure of plural operation signals generated by a plurality of pilot operating units is detected by a shuttle valve, and the thus-detected maximum pressure is used as a control signal pressure to operate a control device such as a regulator for a hydraulic pump.

BACKGROUND ART

As conventional art of this type, there is one disclosed in JP 11-082416 A.

According to this conventional technique, a hydraulic circuit system which is for arrangement, for example, in a hydraulic working machine is provided with at least one hydraulic pump, for example, two hydraulic pumps; plural actuators driven by hydraulic fluids delivered from these hydraulic pumps, for example, a right track motor, a left track motor, a swing motor, a boom cylinder, an arm cylinder and a bucket cylinder; plural flow control valves for feeding the hydraulic fluids, which have been delivered from the hydraulic pumps, respectively, to the above-mentioned plural actuators; a pilot hydraulic pressure source, and plural pilot operating units for producing operation signal pressures from the pilot hydraulic pressure source to change over the corresponding flow control valves.

The hydraulic circuit system also has shuttle valves for selecting maximum pressures of plural groups of operation signal pressures among the operation signal pressures produced by the above-mentioned plural pilot operating units; hydraulic selector valves arranged in association with the plural groups of operation signal pressures to operate based on the maximum pressures such that corresponding control signal pressures are produced from the pressure of the pilot hydraulic pressure and source and are outputted as pump control signals or the like; and a shuttle block with all of the above-mentioned shuttle valves and the above-mentioned hydraulic selector valves built therein.

The hydraulic circuit system is constructed such that it produces the above-mentioned control signal pressures in the shuttle block and by the control signal pressures, operates one or more operation devices arranged in association with any one or more of the hydraulic pumps, actuators and flow control valves, for example, one or more regulators for the hydraulic pump or pumps.

As the conventional technique constructed as described above is provided in the shuttle block with the plural shuttle valves and produces, produces in the shuttle block the control signal pressures for operating the operation devices, and outputs the control signal pressures, piping is no longer needed between the shuttle valves so that the construction of the circuit can be simplified. Accordingly, the hydraulic circuit system assures an improvement in assembly workability, can minimize losses upon transmission of signal pressures, and can operate control devices such as regulators with good responsibility.

With the above-described conventional technique, however, when the flow control characteristics of the regulators for the hydraulic pumps are determined in conformity with boom-raising operations, traveling operations and the like each of which requires a high pressure even when operated delicately, the delivery flow rate of the pumps increase even in a boom-raising operation or superstructure-swinging operation in which it is not desired to produce a pressure too much. As a consequence, the pressure becomes high, so that the operability of the boom-raising operation or superstructure-swinging operation is deteriorated to lead to a reduction in the accuracy of work performed by the hydraulic working machine. When the flow control characteristics of the regulators for the hydraulic pumps are conversely determined to produce a pressure at a suppressed level with a view to improving the operability of a boom-raising operation or superstructure-swinging operation, the operability of various operations which require high pressures such as boom-raising operations and traveling operations is deteriorated, resulting in a problem that the accuracy of various work performed by the hydraulic working machine is lowered.

The present invention has been completed in view of the reality of the above-described conventional technique, and has an object thereof the provision of a hydraulic circuit system for a hydraulic working machine, which can smoothly perform both of an operation requiring a high pressure and an operation which desires the production of a pressure at a suppressed level.

DISCLOSURE OF THE INVENTION

To achieve the above-described object, the present invention provides a hydraulic circuit system for a hydraulic working machine, said hydraulic circuit system comprising at least one hydraulic pump, plural actuators driven by a hydraulic fluid delivered from the hydraulic pump, plural flow control valves for feeding the hydraulic fluid, which has been delivered from the hydraulic pump, to the plural actuators, respectively, a pilot hydraulic pressure source, plural pilot operating units for producing operation signal pressures from the pilot hydraulic pressure source to change over the corresponding flow control valves, shuttle valves for selecting maximum pressures from plural groups of operation signal pressures among the operation signal pressures produced by the plural pilot operating units, a hydraulic selector valve arranged in association with at least one of the plural operation signal pressure groups and operated based on the maximum pressure to produce a corresponding control signal pressure from the pressure of the pilot pressure source, and a shuttle block with all of the shuttle valves and hydraulic selector valve built therein such that the control signal pressures are produced in the shuttle block to operate at least one control device arranged in association with any one of the hydraulic pump, the actuators and the flow control valves, wherein in addition to the hydraulic selector valve operated based on the maximum pressure, at least one of a boom-lowering, hydraulic selector valve, which is operated based on an operation signal pressure relating to a single boom-lowering operation among the operation signal pressures produced by the pilot operating units, and a superstructure-swinging, hydraulic selector valve, which is operated based on an operation signal pressure relating to a swing revolving operation to produce a swing control signal pressure from the pressure of the pilot pressure source, is built in the shuttle block.

According to the present invention constructed as described above, when a boom-lowering, hydraulic selector valve is provided, for example, the boom-lowering, hydraulic selector valve, upon performing a single boom-lowering operation, is changed over responsive to an operation signal pressure relating to a boom-lowering operation, and a boom-lowering control signal pressure is produced in the shuttle block and is outputted to an operation device, for example, a regulator for the hydraulic pump. Accordingly, the regulator is operated such that from the hydraulic pump, a hydraulic fluid is delivered at a flow rate commensurate with the boom-lowering control signal pressure.

When a superstructure-swinging, hydraulic selector valve is provided, for example, the superstructure-swinging, hydraulic selector valve, upon performing a single superstructure-swinging operation, is changed over responsive to an operation signal pressure relating to a superstructure-swinging operation, and a swing control signal pressure is produced in the shuttle block and is outputted to an operation device, for example, the regulator for the hydraulic pump. Accordingly, the regulator is operated such that from the hydraulic pump, a hydraulic fluid is delivered at a flow rate commensurate with the swing control signal pressure.

Upon performing an operation other than such a single boom-lowering operation or single superstructure-swinging operation as described above, for example, the maximum pressure of a group of operation signal pressures relating to the operation is selected through the plural shuttle valves, and responsive to the maximum pressure, a hydraulic selector valve different from the above-mentioned boom-lowering, hydraulic selector valve or superstructure-swinging, hydraulic selector valve is changed over such that a corresponding control signal pressure is produced in the shuttle block and is outputted to an operation device, for example, the regulator for the hydraulic pump.

Therefore, the regulator is operated such that from the hydraulic pump, a hydraulic fluid is delivered at a flow rate commensurate with the control signal pressure outputted based on the above-mentioned maximum pressure.

If the regulator is, for example, of such a type that it operates to deliver a hydraulic fluid at a higher flow rate from the hydraulic pump as the applied control signal pressure becomes higher, presetting is performed such that the value of a boom-lowering control signal pressure outputted with a change-over operation of the boom-lowering, hydraulic selector valve or the value of a superstructure-swinging, control signal pressure outputted with a change-over operation of the superstructure-swinging, hydraulic selector valve becomes lower than the value of a control signal pressure outputted with a change-over operation of the hydraulic selector valve operated based on the above-mentioned maximum pressure.

As a consequence, upon performing an operation which requires a high pressure, a control signal pressure outputted with a change-over operation of a hydraulic selector valve operated based on the maximum pressure of the group of operation signal pressures relating to the relevant operation is applied to the regulator so that the regulator is operated to increase the flow rate of the hydraulic pump and hence, the high-pressure operation can be performed. Upon performing a single boom-lowering operation or a single superstructure-swinging operation, in other words, an operation which desires to produce a pressure at a suppressed level, a boom-lowering control signal pressure or superstructure-swinging control signal pressure outputted with a change-over operation of the boom-lowering, hydraulic selector valve or superstructure-swinging, hydraulic selector valve is applied to the regulator so that the regulator is operated to suppress the flow rate of the hydraulic pump and hence, the single boom-lowering operation or single superstructure-swinging operation, which desires the production of a pressure at a suppressed level, can be performed.

According to the present invention, it is, therefore, possible to smoothly perform both of an operation, which requires a high pressure, and a single boom-lowering operation or superstructure-swinging operation, which desires the production of a pressure at a suppressed level, and hence, to assure good operability.

When constructed as mentioned above, the control signal pressures produced from the boom-lowering, hydraulic selector valve and superstructure-swinging, hydraulic selector valves may comprise a pressure signal for operating the control device arranged in association with the hydraulic pump.

In this case, with respect to equal operation signal pressures from the pilot operating units, a delivery flow rate from the hydraulic pump based on control signal pressures produced from the boom-lowering selector valve and superstructure-swinging, hydraulic selector valves may be smaller than a delivery flow rate from the hydraulic pump based on a control signal pressure produced from another hydraulic selector valve for operating the control device arranged in association with the pump.

BEST MODES FOR CARRYING OUT THE INVENTION

The embodiments of the hydraulic circuit system according to the present invention for the hydraulic working machine will hereinafter be described based on the drawings.

Figure 1:
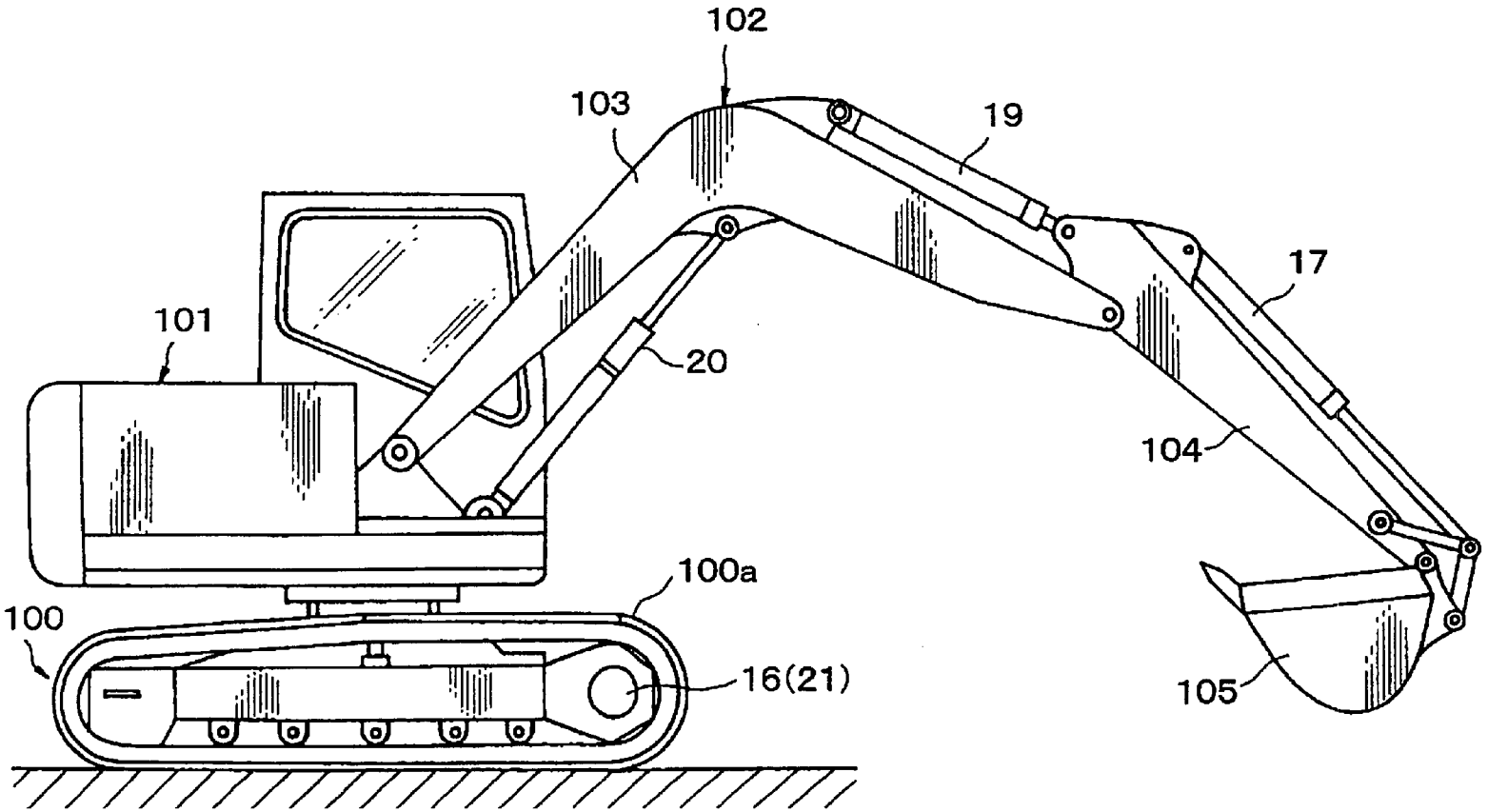
FIG. 1 is a side view of a hydraulic excavator shown as an example of a hydraulic working machine in which the hydraulic circuit system according to any one of embodiments of the present invention can be installed.

FIG. 1 is the side view of the hydraulic excavator shown as an example of the hydraulic working machine in which the hydraulic circuit system according to any one of the embodiments of the present invention can be installed.

The hydraulic excavator is provided with a lower travel base 100, an upper swing superstructure 101, and a work front 102. Right and left track motors 16,21 are mounted on the lower travel base 100 to rotationally drive respective crawlers 100*a*, whereupon the excavator travels forward or rearward.

A swing motor 18 which will be described subsequently herein is mounted on the upper swing superstructure 101 to swing the upper swing superstructure 101 rightwards or leftwards relative to the lower travel base 100. The work front 102 is made up of a boom 103, an arm 104 and a bucket 105. The boom 103 is vertically pivoted by a boom cylinder 20, the arm 104 is operated by an arm cylinder 19 toward a dumping (open) side or a crowding (filling) side, and the bucket 105 is operated by a bucket cylinder 17 toward the dumping (open) side or the crowding (filling) side.

Figure 2:
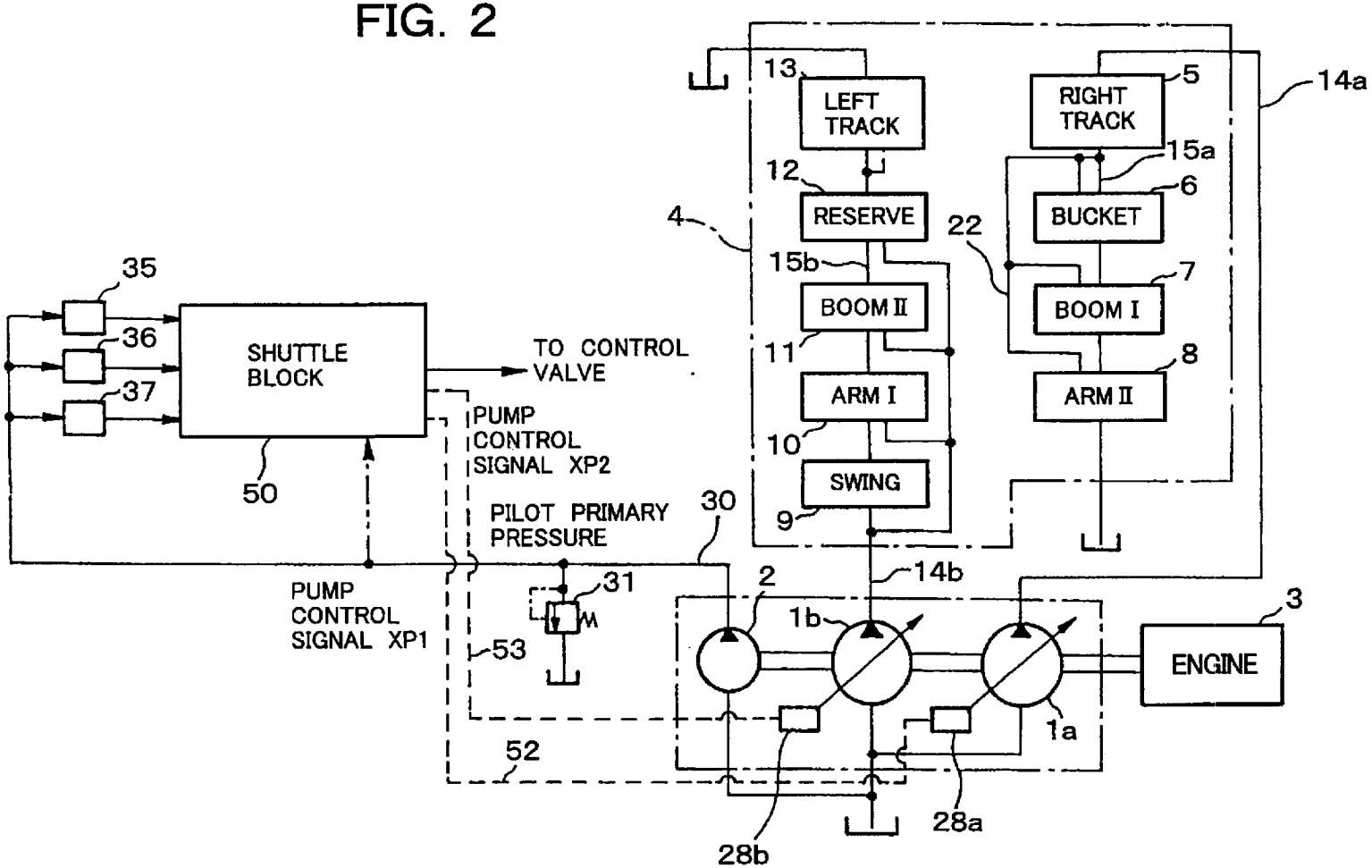
FIG. 2 is a hydraulic circuit diagram illustrating the overall construction of a first embodiment of the hydraulic circuit system according to the present invention, which is installed in the hydraulic excavator shown in FIG. 1.
Figure 3:
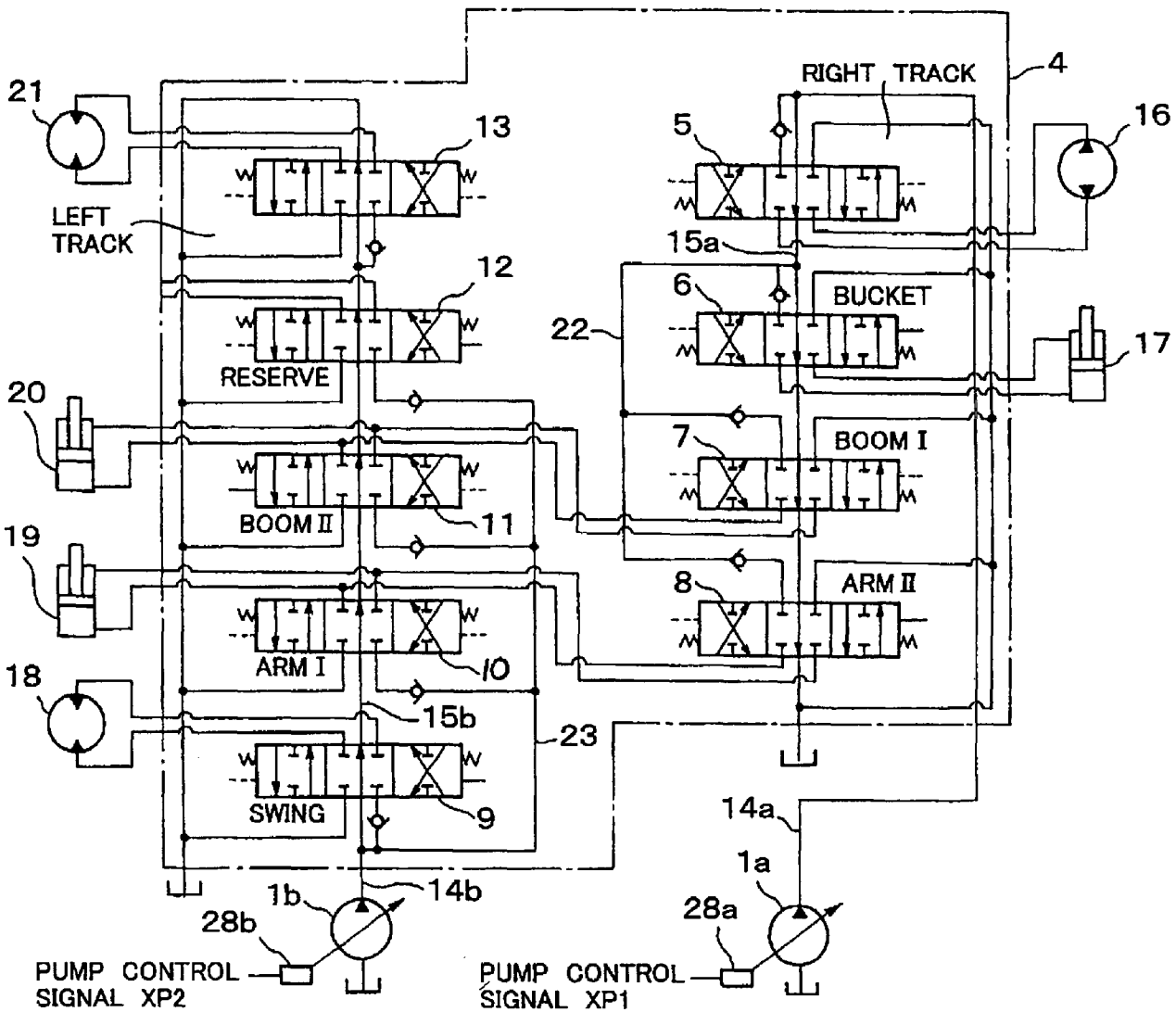
FIG. 3 is a hydraulic circuit diagram depicting flow control valves and actuators arranged in the first embodiment of the present invention illustrated in FIG. 2.
Figure 4:
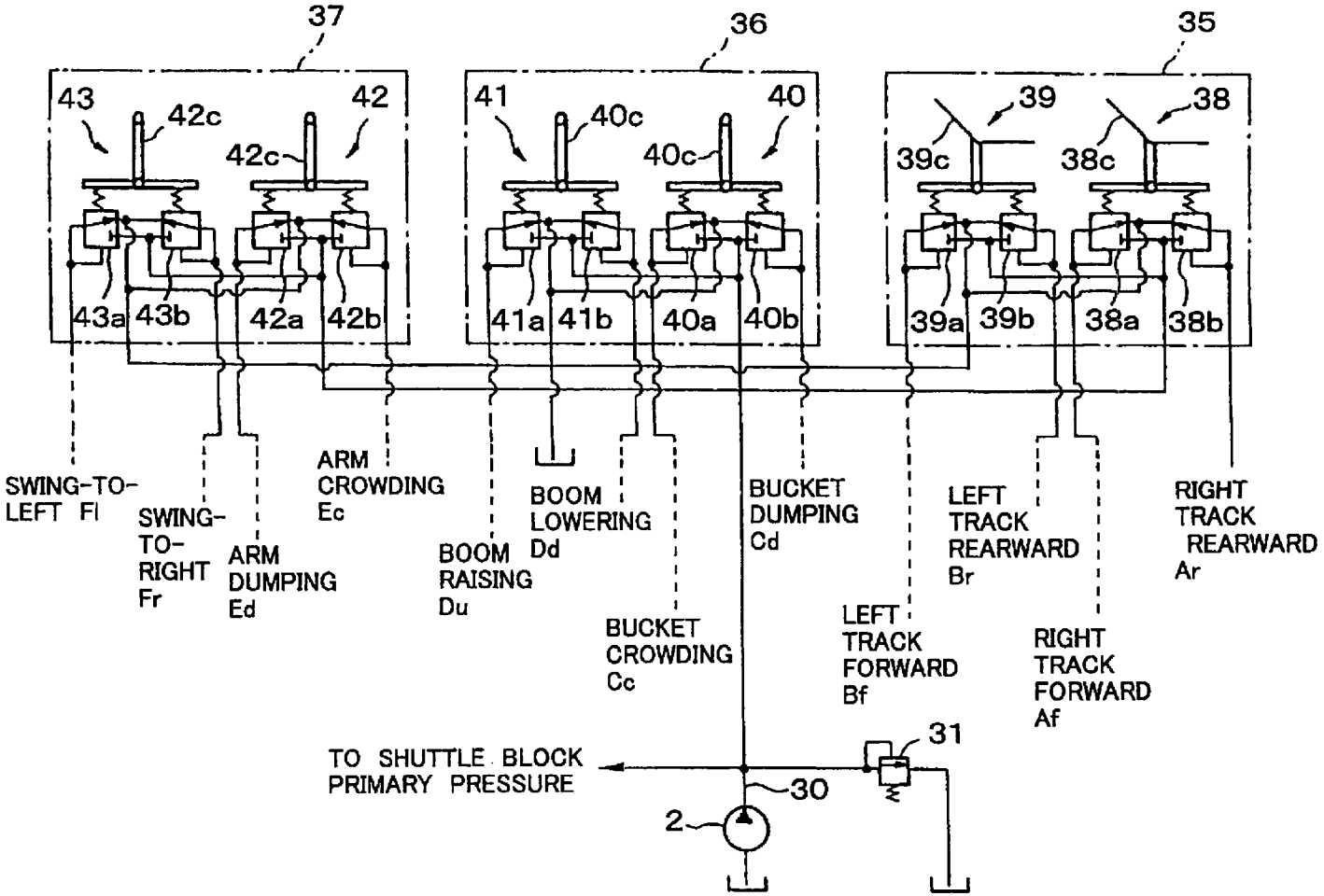
FIG. 4 is a hydraulic circuit diagram showing pilot operating units for changing over the flow control valves depicted in FIG. 3.
Figure 5:
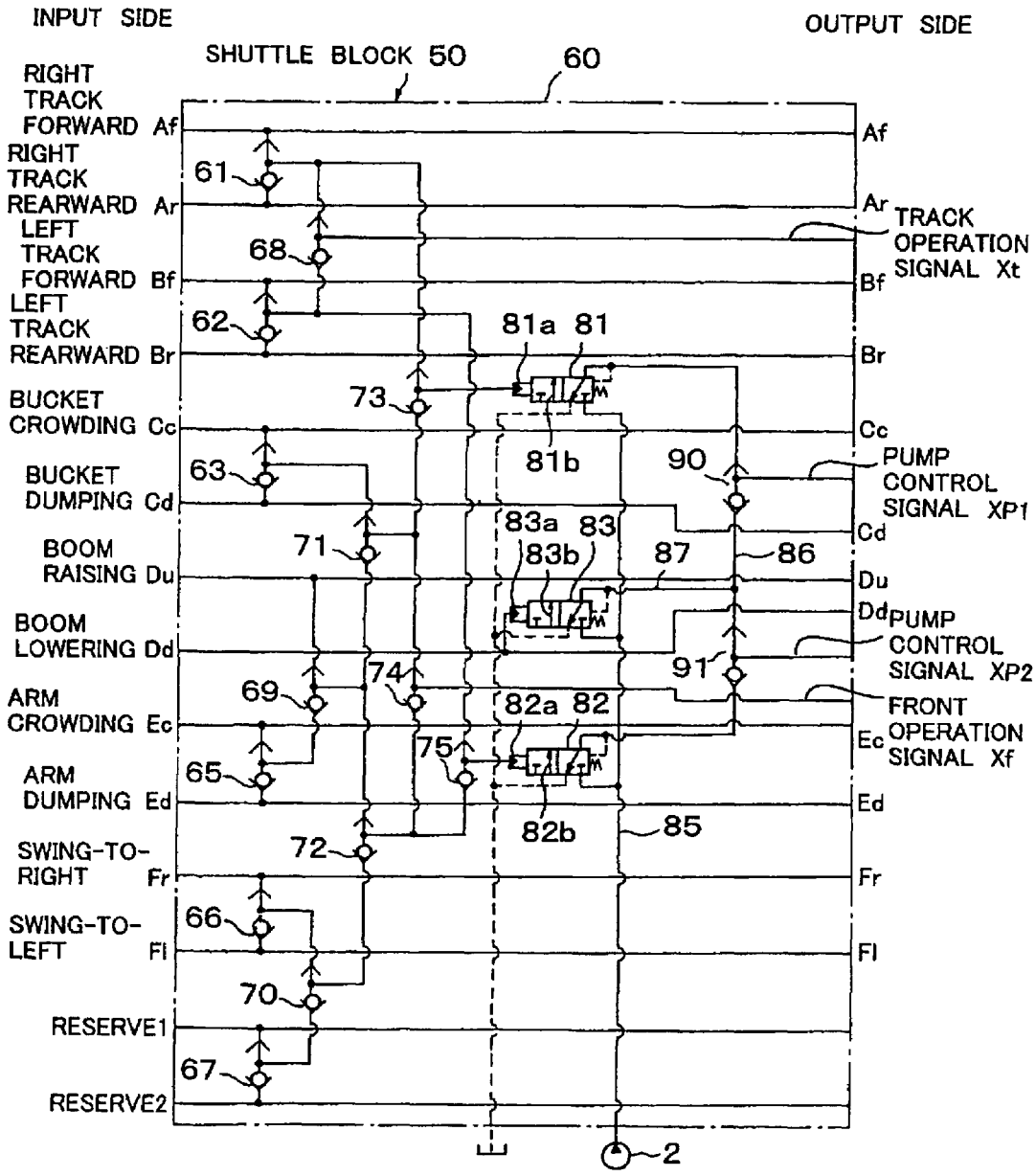
FIG. 5 is a hydraulic circuit diagram illustrating a shuttle block arranged in the first embodiment shown in FIG. 2.

FIGS. 2 through 5 are illustrations of the first embodiment of the present invention, in which FIG. 2 is the hydraulic circuit diagram illustrating the overall construction of the first embodiment of the hydraulic circuit system according to the present invention, which is installed in the hydraulic excavator shown in FIG. 1, FIG. 3 is the hydraulic circuit diagram depicting the flow control valves and the actuators arranged in the first embodiment of the present invention illustrated in FIG. 2, FIG. 4 is the hydraulic circuit diagram showing pilot operating units for changing over the flow control valves depicted in FIG. 3, and FIG. 5 is the hydraulic circuit diagram illustrating the shuttle block arranged in the first embodiment shown in FIG. 2.

As shown in FIG. 2, this first embodiment is provided with main hydraulic pumps 1*a*, 1*b*, a pilot pump 2, an engine 3 for rotationally driving the pumps 1*a*, 1*b* and 2, and a valve unit 4 connected to the main hydraulic pumps 1*a*,1*b*. The valve unit 4 has two valve groups, i.e., a group of flow control valves 5-8 and a group of flow control valves 9-13. The flow control valves 5-8 are positioned on a center bypass line 15*a* which is connected to a delivery line 14*a* of the main hydraulic pump 1*a*, while the flow control valves 9-13 are positioned on a center bypass line 15*b* which is connected to a delivery line 14*b* of the main hydraulic pump 1*b*.

The main hydraulic pumps 1*a*, 1*b* are variable displacement pumps of swash plate type, and these hydraulic pumps 1*a*, 1*b* are provided with regulators 28*a*, 28*b* for controlling tiltings of respective swash plates, i.e., displacements.

A pilot relief valve 31 for holding a delivery pressure of the pilot pump 2 at a constant pressure is connected to a delivery line 30 of the pilot pump 2. The pilot pump 2 and the pilot relief valve 31 jointly constitute a pilot hydraulic source.

The flow control valves 5-8 and 9-13 of the valve unit 4 are changed over by operation signal pressures from pilot operating units 35,36,37. The pilot operating units 35,36,37 generate respective operation signal pressures based on the delivery pressure (constant pressure) of the pilot pump 2 as a source pressure.

The operation signal pressures generated by the pilot operating units 35,36,37 are once introduced into a shuttle block 50, and then applied to the flow control valves 5-8 and 9-13 through the shuttle block 50 as shown in FIG. 2. Based on the operation signal pressures from the pilot operating units 35,36,37, a front operation signal Xf, a track operation signal Xt and pump control signals XP1, XP2 are produced in the shuttle block 50 as will be mentioned below. For example, the pump control signals XP1, XP2 are outputted as control signal pressures to pump regulators 28*a*,28*b* through signal lines 52,53, respectively.

As shown in FIG. 3, the flow control valves 5-8 and 9-13 included in the valve unit 4 are of the center bypass type.

Hydraulic fluids delivered from the main hydraulic pumps 1*a*,1*b* are supplied to corresponding one or more of the actuators through these flow control valves 5-13. The actuators consist of the right track motor 16, the bucket cylinder 17, the swing motor 18, the arm cylinder 19, the boom cylinder 20, and the left track motor 21.

The flow control valve 5 is for the right track, the flow control valve 6 is for the bucket, the flow control valve 7 is for the first boom, the flow control valve 8 is for the second arm, the flow control valve 9 is for swing, the flow control valve 10 is for the first arm, the flow control valve 11 is for the second boom, the flow control valve 12 is for reserve, and the flow control valve 13 is for the left track. Namely, the two flow control valves 7, 11 are provided for the boom cylinder 20 and the two flow control valves 8, 10 are provided for the arm cylinder 19 such that the hydraulic fluids from the two hydraulic pumps 1*a*, 1*b* are combined together and fed to the boom cylinder 20 and the arm cylinder 19.

As illustrated in FIG. 4, the pilot operating unit 35 consists of a pilot operating device 38 for the right track and a pilot device 39 for the left track. These pilot operating devices are provided with pairs of pilot valves (reducing valves) 38*a*,38*b*; 39*a*,39*b* and control pedals 38*c*,39*c*, respectively. When the control pedal 38*c* is trod in the back-and-forth direction, one of the pilot valves 38*a*,38*b* is operated depending on the direction of the treading, and an operation signal pressure Af or Ar is produced depending on the stroke of the treading. When the control pedal 39*c* is trod in the back-and-forth direction, one of the pilot valves 39*a*,39*b* is operated depending on the direction of the treading, and an operation signal pressure Bf or Br is produced depending on the stroke of the treading. The operation signal pressure Af is used for moving the right track forward and the operation signal pressure Ar is used for moving the right track rearward, whereas the operation signal pressure Bf is used for moving the left track forward and the operation signal pressure Br is used for moving the left track rearward.

The pilot operating unit 36 consists of a pilot operating device 40 for the bucket and a pilot operating device 41 for the boom. These pilot operating devices comprise pairs of pilot valves (reducing valves) 40*a*,40*b*;41*a*,41*b*, respectively, and a common control lever 40*c*. When the control lever 40*c* is manipulated in the left-and-right direction, one of the pilot valves 40*a*,40*b* is operated depending on the direction of the manipulation, and an operation signal pressure Cc or Cd is produced depending on the stroke of the manipulation. When the control lever 40*c* is manipulated in the back-and-forth direction, one of the pilot valves 41*a*,41*b* is operated depending on the direction of the manipulation, and an operation signal pressure Du or Dd is produced depending on the stroke of the manipulation.

The operation signal pressure Cc is used for crowding the bucket and the operation signal pressure Cd is used for dumping the bucket, whereas the operation signal pressure Du is used for raising the boom and the operation signal pressure Dd is used for lowering the boom.

The pilot operating unit 37 consists of a pilot operating device 42 for the arm and a pilot operating device 43 for swing.

These pilot operating devices comprise pairs of pilot valves (reducing valves) 42*a*,42*b*;43*a*,43*b*, respectively, and a common control lever 42*c*. When the control lever 42*c* is manipulated in the left-and-right direction, one of the pilot valves 42*a*,42*b* is operated depending on the direction of the manipulation, and an operation signal pressure Ec or Ed is produced depending on the stroke of the manipulation. When the control lever 42*c* is manipulated in the back-and-forth direction, one of the pilot valves 43*a*,43*b* is operated depending on the direction of the manipulation, and an operation signal pressure Fr or Fl is produced depending on the stroke of the manipulation. The operation signal pressure Ec is used for crowding the arm and the operation signal pressure Ed is used for dumping the arm, whereas the operation signal pressure Fr is used for swinging the upper swing superstructure to the right and the operation signal pressure Fl is used for swinging it to the left.

The shuttle block 50 shown in FIG. 5 is provided with a main unit 60, shuttle valves 61-63,65-75,90,91 which are built in the main unit 60, hydraulic selector valves 81,82 operated responsive to the maximum pressure in a group of operation signal pressures relating to various operations, and boom-lowering, hydraulic selector valve 83 operated responsive to an operation signal pressure Dd relating to a boom lowering operation.

The shuttle valves 61-63,65-67 are disposed in an upstream stage of a shuttle valve group. The shuttle valve 61 selects the higher one of the operation signal pressure Af for moving the right track forward and the operation signal pressure Ar for moving the right track rearward. The shuttle valve 62 selects the higher one of the operation signal pressure Bf for moving the left track forward and the operation signal pressure Br for moving the left track rearward. The shuttle valve 63 selects the higher one of the operation signal pressure Cc for crowding the bucket and the operation signal pressure Cd for dumping the bucket. The shuttle valve 65 selects the higher one of the operation signal pressure Ec for crowding the arm and the operation signal pressure Ed for dumping the arm. The shuttle valve 66 selects the higher one of the operation signal pressure Fr for swinging the upper swing superstructure to the right and the operation signal pressure Fl for swinging it to the left.

The shuttle valve 67 selects the higher one of operation signal pressures from a pair of pilot valves of a reserve pilot operating unit which is arranged when a reserve actuator is connected to the reserve flow control valve 12.

The shuttle valves 68-70 are disposed in a second stage of the shuttle valve group. The shuttle valve 68 selects the higher one of the operation signal pressures selected by the shuttle valves 61,62 in the first stage. The shuttle valve 69 selects the higher one of the operation signal pressure Du for raising the boom and the operation signal pressure selected by the shuttle valve 65 in the most upstream stage. The shuttle valve 70 selects the higher one of the operation signal pressures selected by the shuttle valves 66,67 in the most upstream stage.

The shuttle valves 71,72 are disposed in a third stage of the shuttle valve group. The shuttle valve 71 selects the higher one of the operation signal pressures selected by the shuttle valve 63 in the most upstream stage and the shuttle valve 69 in the second stage. The shuttle valve 72 selects the higher one of the operation signal pressures selected by the shuttle valves 69,70 in the second stage.

The shuttle valves 73,74 are disposed in a fourth stage of the shuttle valve group. The shuttle valve 73 selects the higher one of the operation signal pressures selected by the shuttle valve 61 in the most upstream stage and the shuttle valve 71 in the third stage. The shuttle valve 74 selects the higher one of the operation signal pressures selected by the shuttle valves 71,72 in the third stage.

The shuttle valve 75 is disposed in a fifth stage of the shuttle valve group and selects the higher one of the operation signal pressures selected by the shuttle valve 62 in the most upstream stage and the shuttle valve 72 in the third stage.

The hydraulic selector valve 81 disposed in a downstream stage of the shuttle valve 73 in the fourth stage is changed over by the application of the operation signal pressure, which has been selected by the shuttle valve 73, to a pressure receiving parts 81*a*, and produces a corresponding control signal pressure from the pressure of the pilot pump 2.

Further, the hydraulic selector valve 82 disposed in a downstream stage of the shuttle valve 75 is changed over by the application of the operation signal pressure, which has been selected by the shuttle valve 75, to a pressure receiving part 82*a* produces a corresponding control signal pressure from the pressure of the pilot pump 2.

The boom-lowering, hydraulic selector valve 83 disposed in addition to these hydraulic selector valves 81,82 is changed over by the application of the operation signal pressure Dd, which relates to a boom-lowering operation, to a pressure receiving part 83*a*, produces a corresponding boom-lowering control signal pressure from the pressure of the pilot pump 2.

The external dimensions of the above-mentioned hydraulic selector valves 81,82 and boom-lowering, hydraulic selector valve 83, including their springs, are set equal, for example.

Figure 6:
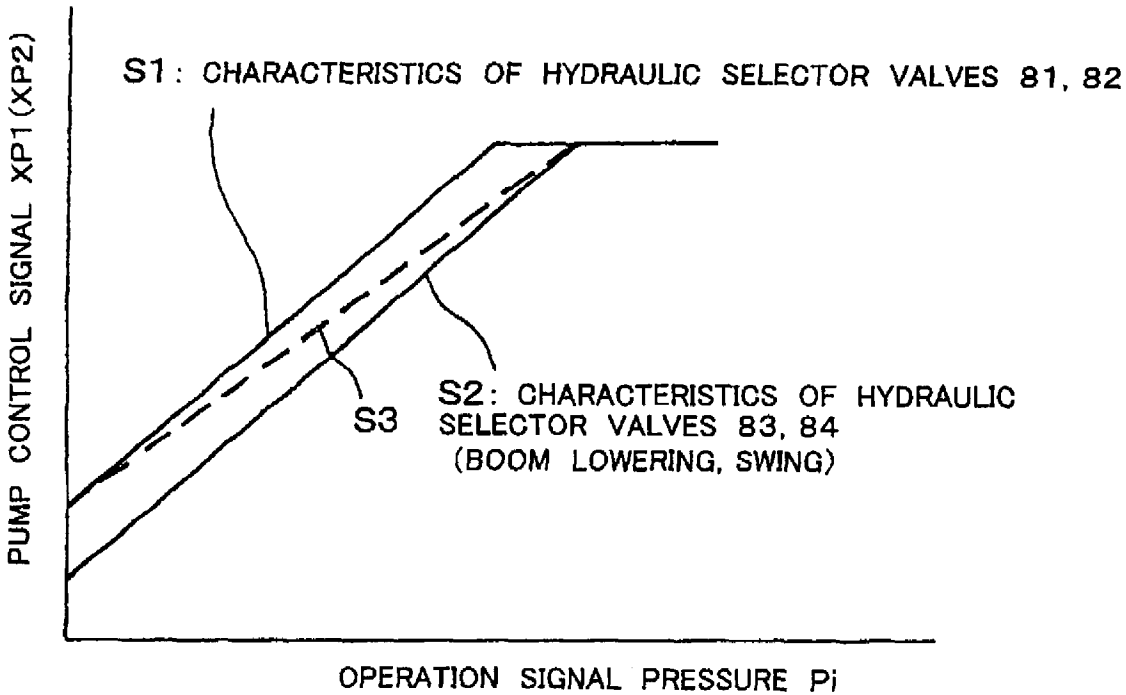
FIG. 6 is a characteristic diagram illustrating pilot pressure (operation signal pressure) and pump control signal characteristics available from the first embodiment of the present invention.

However, the cross-sectional area of a line 83*b* in the boom-lowering, hydraulic selector valve 83 communicating a line 85, which is in communication with the pilot pump 2, and a line 87, which is in communication with a line 86 between the shuttle valves 90 and 91, is set smaller beforehand compared with the cross-sectional areas of lines 81*b*,82*b* in the hydraulic selector valves 81,82. As illustrated in FIG. 6, owing to this setting, the characteristics of the boom-lowering, hydraulic selector valve 83 are represented by characteristics S2 which have been parallelly shifted downwards relative to characteristics S1 of the control signal pressure outputted responsive to an operation signal pressure Pi applied to the pressure receiving parts 81*a*,82*b* of the hydraulic selector valves 81,82, that is, the pump control signal XP1 (XP2). Namely, when the level of the operation signal pressure Pi is equal, the values of control signal pressures outputted from the boom-lowering, hydraulic selector valve 83 (the pump control signals XP1,XP2) become lower compared with the values of control signal pressures outputted from the boom-raising, hydraulic selector valves 81,82 (the pump control signals XP1,XP2).

Returning again to FIG. 5, a description will now be made.

In the most downstream stage, the shuttle valves 90,91 are disposed. Of these, the shuttle valve 90 selects the higher one of the control signal pressure produced at the hydraulic selector valve 81 and the boom-lowering, control signal pressure produced at the boom-lowering, hydraulic selector valve 83, and outputs it as the pump control signal XP1.

The shuttle valve 91 selects the higher one of the control signal pressure produced at the hydraulic selector valve 82 and the control signal pressure produced at the boom-lowering, hydraulic selector valve 83, and outputs it as the pump control signal XP2.

Incidentally, the operation signal pressure selected by the shuttle valve 68 is outputted as the track operation signal Xt, and is used for controlling the track system. On the other hand, the operation signal pressure selected by the shuttle valve 74 is outputted as the front operation signal Xf, and is used for controlling driving of the work front 102.

The pump control signals XP1,XP2 outputted from the shuttle valves 90,91, respectively, are fed to the pump regulators 28*a*,28*b* via the signal lines 52,53 illustrated in FIG. 2. Namely, the pump regulators 28*a*,28*b* control the delivery flow rates of the hydraulic pumps 1*a*,1*b* in accordance with the values of the pump control signals XP1,XP2.

Operations in the first embodiment constructed as described above will hereinafter be described.

[Individual Operations Except for a Single Boom-lowering Operation]

When at least one of the pilot operating unit 38 for the right track, the pilot operating unit 40 for the bucket, the pilot operating unit 41 when used in a boom raising operation, for example, and the pilot operating unit 42 for the arm is manipulated, the corresponding operation signal pressure is applied to the corresponding one of the flow control valves 5-8.

In the case of one operation signal pressure, the operation signal pressure is applied to the pressure receiving part 81*a* of the hydraulic selector valve 81, and in the case of plural operation signal pressures, the maximum one of the plural operation signal pressures is selected by the shuttle valves 61,63,65,69,71,73 and is applied to the pressure receiving part 81*a* of the hydraulic selector valve 81. As a result, the hydraulic selector valve 81 is changed over, and a control signal pressure is outputted from this hydraulic selector valve 81 and is outputted as the pump control signal XP1 to the regulator 28*a* for the main hydraulic pump 1*a* through the shuttle valve 90. The regulator 28*a* has such a characteristic that the tilting of the main hydraulic pump 1*a* is increased, for example, as the pressure of the pump control signal XP1 rises. Upon application of the pump control signal XP1, the regulator 28*a* increases the delivery rate of the main hydraulic pump 1*a* in accordance with the pump control signal XP1. As a result, one or more of the flow control valves corresponding to the one or more operation signal pressures are changed over, and the hydraulic fluid is delivered from the main hydraulic pump 1*a* at a flow rate corresponding to the operation signal pressure. The hydraulic fluid is fed to the corresponding one or more of the right track motor 16, the bucket cylinder 17, the arm cylinder 19 and the boom cylinder 20 such that these actuators are driven.

When at least one of the pilot operating unit 39 for the left track, the pilot operating unit 41 when used in a boom raising operation, for example, the pilot operating unit 42 for the arm, and the pilot operating unit 43 for swing is manipulated, the corresponding operation signal pressures is applied to the corresponding one of the flow control valves 9, 10 and 11. In the case of one operation signal pressure, the operation signal pressure is applied to the pressure receiving part 82*a* of the hydraulic selector valve 82, and in the case of plural operation signal pressures, the maximum one of the plural operation signal pressures is selected by the shuttle valves 62,65,66,69,70,72,75 and is applied to the pressure receiving part 82*a* of the hydraulic selector valve 82. As a result, the hydraulic selector valve 82 is changed over, and is outputted as the pump control signal XP2 to the pump regulator 28*b* through the shuttle valve 91. Like the regulator 28*a*, the pump regulator 28*b* also has such a characteristic that the tilting of the main hydraulic pump 1*b* is increased, for example, as the pressure of the pump control signal XP2 rises. Upon application of the pump control signal XP2, the regulator 28*b* increases the delivery rate of the main hydraulic pump 1*b* in accordance with the pump control signal XP2. As a result, one or more of the flow control valves corresponding to the one or more operation signal pressures are changed over, and the hydraulic fluid is delivered from the main hydraulic pump 1*b* at a flow rate corresponding the operation signal pressure. The hydraulic fluid is fed to the corresponding one or more of the swing motor 18, the arm cylinder 19, the boom cylinder 20 and the left track motor 21 such that these actuators are driven.

When at least one of the pilot operating unit 40 for the bucket, the pilot operating unit 41 when used in a boom raising operation, the pilot operating unit 42 for the arm, and the pilot operating unit 43 for swing is manipulated, the corresponding operation signal pressure is applied to the corresponding one of the flow control valves 6, 7, 8, 9, 10 and 11. In the case of one operation signal pressure, the operation signal pressure is outputted as the front operation signal Xf, and in the case of plural operation signal pressures, the maximum one of the plural operation signal pressures is selected by the shuttle valves 63,65,66,69,70,71,72,74, and then outputted as the front operation signal Xf.

When at least one of the pilot operating unit 40 for the bucket, the pilot operating unit 41 when used in a boom raising operation, the pilot operating unit 42 for the arm, and the pilot operating unit 43 for swing is additionally manipulated with intent to carry out a combined track/front operation under a condition where the pilot operating unit 38 for the right track and the pilot operating unit 39 for the left track have been manipulated, the corresponding operation signal pressures are applied to the flow control valves 5, 13 and the corresponding one or more of the flow control valves 6, 7, 8, 9, 10 and 11.

The maximum one of the operation signal pressures from the pilot operating unit 40 for the bucket, the pilot operating unit 41 when used in a boom raising operation, the pilot operating unit 42 for the arm, and the pilot operating unit 43 for swing is selected by the shuttle valves 63,65,66,69,70,71,72,74, and then outputted as the front operation signal Xf.

Further, when at least one of all the pilot operating operations except for the operation of the pilot operating device when used in a boom raising operation (operations of the pilot operating unit 38 for the right track, the pilot operating unit 39 for the left track, the pilot operating unit 40 for the bucket, the pilot operating unit 41 when used in a boom raising operation, the pilot operating unit 42 for the arm, and the pilot operating unit 43 for swing) is performed, the corresponding operation signal pressure is applied to the corresponding one of the flow control valves 5-11 and 13. In addition, when at least one of the pilot operating unit 38 for the right track and the pilot operating unit 39 for the left track is manipulated, the maximum one of the operation signal pressures is selected by the shuttle valves 61,62,68 and outputted as the track operation signal Xt.

Also, when at least one of the pilot operating unit 40 for the bucket, the pilot operating unit 41 when used in a boom raising operation, the pilot operating unit 42 for the arm, and the pilot operating unit 43 for swing is manipulated, the maximum one of their operation signal pressures is output as the front operation signal Xf as described above.

[Single Boom-lowering Operation]

Especially when the pilot operating device 41 is operated upon a single boom-lowering operation, the corresponding operation signal pressure Dd is applied to the flow control valves 7,11 and further, the operation signal pressure Dd is applied to the pressure receiving part 83*a* of the boom-lowering, hydraulic selector valve 83 housed in the shuttle valve 50 depicted in FIG. 5. As a result, the hydraulic selector valve 83 is changed over, the boom-lowering control signal pressure is outputted from this boom-lowering, hydraulic selector valve 83, and through the respective shuttle valves 90,91, the pump control signal XP1,XP2 are outputted to the pump regulators 28*a*,28*b* through the signal lines 52,53.

When the single boom lowering operation is effected over a similar stroke as the individual operations other than the single boom lowering operation, the values of the pump control signals XP1,XP2 at this time become, as shown in FIG. 6, lower compared with the values of the pump control signals XP1,XP2 outputted through the hydraulic selector valves 81,82 in association with the other individual operations. As indicated by the characteristics K2 in FIG. 7, the flow rates delivered from the main hydraulic pumps 1*a*,1*b* controlled by the pump regulators 28*a*,28*b*, therefore, tend to be suppressed compared with the characteristics K1 when the pump regulators 28*a*,28*b* are controlled by the pump control signals XP1,XP2 outputted through the hydraulic selector valves 81,82. As a consequence, the pressure produced in the boom cylinder 20 can be controlled to a suppressed low pressure. As has been described above, the first embodiment can perform well a single boom lowering operation which is desired to be performed while controlling the pressure at a suppressed level.

As has been mentioned above, the first embodiment permits smooth performance of both of an operation requiring a high pressure, said operation being other than a single boom lowering operation, and the single boom lowering operation desired to produce a pressure at a suppressed level, assures good operability, and can improve the accuracy of various work performed by the hydraulic excavator.

Figure 8:
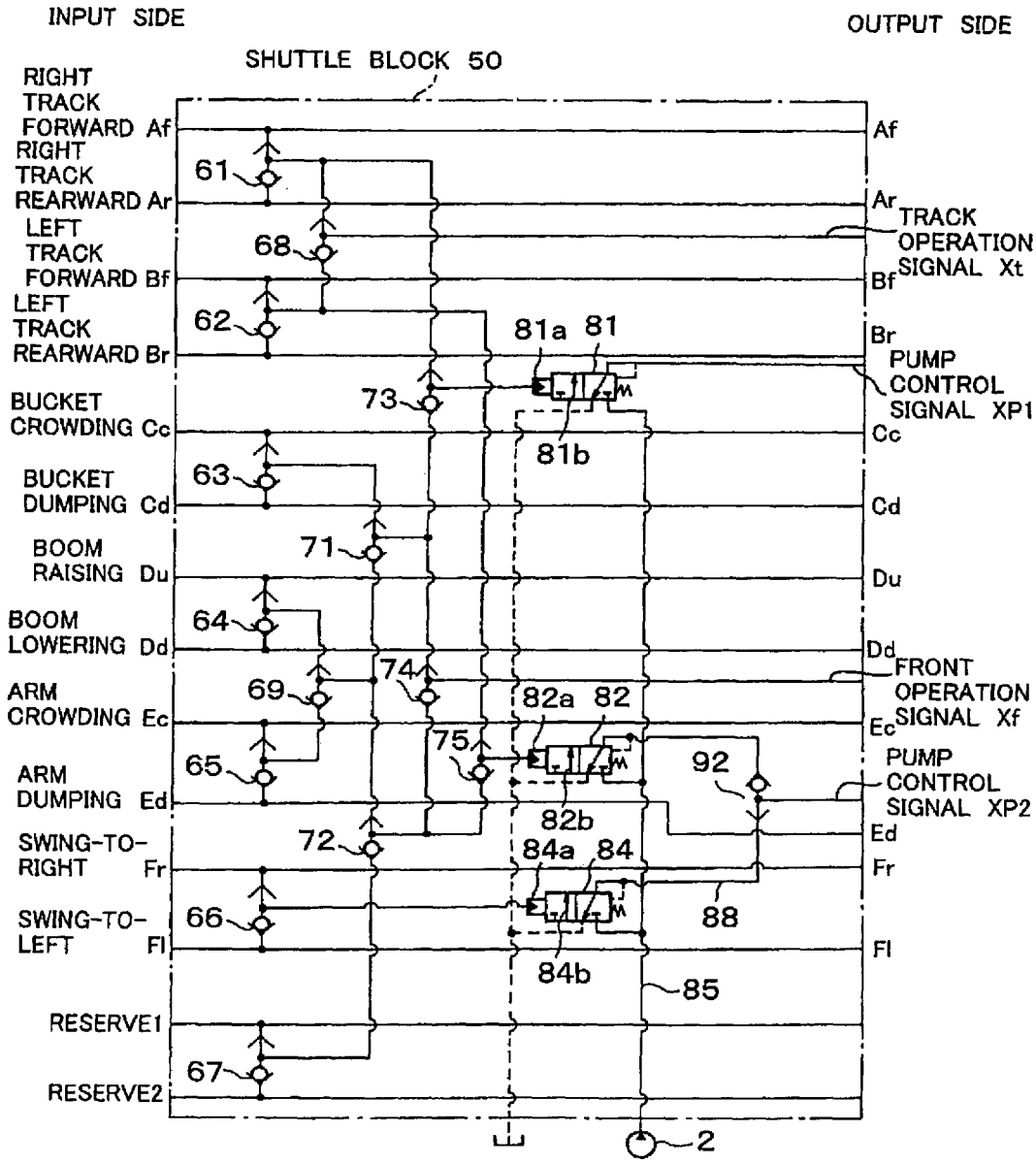
FIG. 8 is a hydraulic circuit diagram depicting a shuttle block which constitutes an essential part of a second embodiment of the present invention.

FIG. 8 is the hydraulic circuit diagram depicting the shuttle block which constitutes the essential part of the second embodiment of the present invention.

In this second embodiment, a shuttle valve 64 which selects the higher one of a boom-raising operation signal pressure Du and a boom-lowering operation signal pressure Dd is disposed in the most upstream stage inside the shuttle block 50. The pressure selected by the shuttle valve 64 is applied to the shuttle valve 69 which is also arranged in the first embodiment.

In particular, the second embodiment is provided with a superstructure-swinging, hydraulic selector valve 84 in addition to the hydraulic selector valves 81,82 which are changed over responsive to the higher pressures selected by the shuttle valves 73,75. By the application of an operation signal pressure, which is selected at the shuttle valve 60 and relates to swinging, to the pressure receiving part 84*a*, this superstructure-swinging, hydraulic selector valve 84 is changed over such that from the pressure of the pilot pump 2, a corresponding superstructure-swinging control signal pressure is produced.

In a downstream stage of the hydraulic selector valve 82 and the superstructure-swinging, hydraulic selector valve 84, a shuttle valve 92 is arranged to select the higher one of control signal pressure produced at the hydraulic selector valve 82 and a superstructure-swinging control signal pressure produced at the superstructure-swinging, hydraulic selector valve 84 and then, to output a pump control signal XP2.

The external dimensions of the above-mentioned hydraulic selector valves 81,82 and superstructure-swinging, hydraulic selector valve 84, including their springs, are set equal, for example. However, the cross-sectional area of a line 84*b* in the superstructure-swinging, hydraulic selector valve 84 communicating the line 85, which is in communication with the pilot pump 2, and a line 88, which is in communication with the shuttle valve 92, with each other is set smaller beforehand compared with the cross-sectional areas of the lines 81*b*,82*b* in the hydraulic selector valves 81,82. As illustrated in FIG. 6, owing to this setting, the characteristics of the superstructure-swinging, hydraulic selector valve 84 are represented by characteristics S2 which have been parallelly shifted downwards relative to characteristics S1 of the pump control signals XP1,XP2 outputted from the hydraulic selector valves 81,82.

The remaining construction is similar to that of the above-described first embodiment.

In the second embodiment constructed as described above, describing, for example, about operations of the pump regulators 28*a*,28*b*, a pump control signal XP1 which is a control signal pressure produced at the hydraulic selector valve 81 is applied to the pump regulator 28*a* through a signal line 52 in each of the operations other than the single superstructure-swinging operation. Further, a pressure selected at the shuttle valve 92, specifically a pump control signal XP2 which is the higher one of the control signal pressure produced at the hydraulic selector valve 82 and a superstructure-swinging control signal pressure produced at the superstructure-swinging, hydraulic selector valve 84 is applied to the pump regulator 28*b* through the signal line 53. By the pump control pressure, the pump regulators 28*a*,28*b* control the delivery flow rates from the main hydraulic pumps 1*a*,1*b*. The values of the pump control signals XP1,XP2 at this time are located on the characteristics S1 in FIG. 6 as mentioned above. On the other hand, the values of the flow rates Q of the main hydraulic pumps 1*a*,1*b* controlled by the pump regulators 28*a*,28*b*, respectively, are located on the characteristics K1 in FIG. 7.

In a single superstructure-swinging operation, the superstructure-swinging control signal pressure produced at the superstructure-swinging, hydraulic selector valve 84 is outputted as the pump control signal XP2 through the shuttle valve 92, and is applied to the pump regulator 28*b*. As a result, the pump regulator 28*b* controls the flow rate to be delivered from the main hydraulic pump 1*b*. The value of the pump control signal XP2 at this time is located on the characteristics S2 in FIG. 6 as mentioned above. Namely, the value of the pump control signal XP2 at this time is lower compared with the value of the pump control value XP2 during the operations other than the single superstructure-swinging operation.

Figure 7:
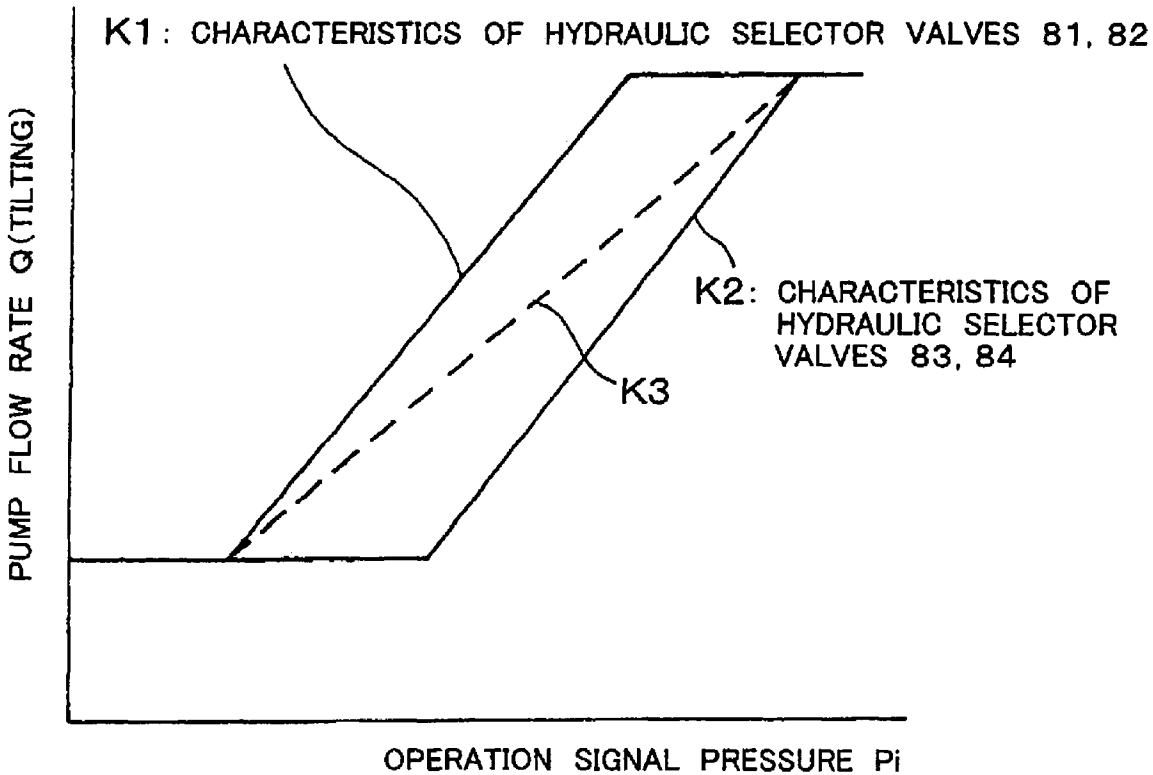
FIG. 7 is a characteristic diagram illustrating pilot pressure (operation signal pressure) and pump flow rate characteristics available from the first embodiment of the present invention.

Therefore, the value of the flow rate Q of the main hydraulic pump 1*b* controlled by the pump regulator 28*b* is located on the characteristics K2 in FIG. 7, and tends to be suppressed compared with the characteristics K1 of the case that the regulator 28*b* is controlled by the pump control signal XP2 outputted through the hydraulic selector valve 82. As a consequence, the pressure produced at the swing motor 18 can be controlled to a suppressed low pressure. As readily appreciated from the foregoing, the second embodiment can perform well a single boom lowering operation which is desired to be performed while controlling the pressure at a suppressed level.

As has been described above, the second embodiment permits smooth performance of both of an operation requiring a high pressure, said operation being other than a single superstructure-swinging operation, and the single superstructure-swinging operation desired to produce a pressure at a suppressed level, assures good operability, and can improve the accuracy of various work performed by the hydraulic excavator.

Figure 9:
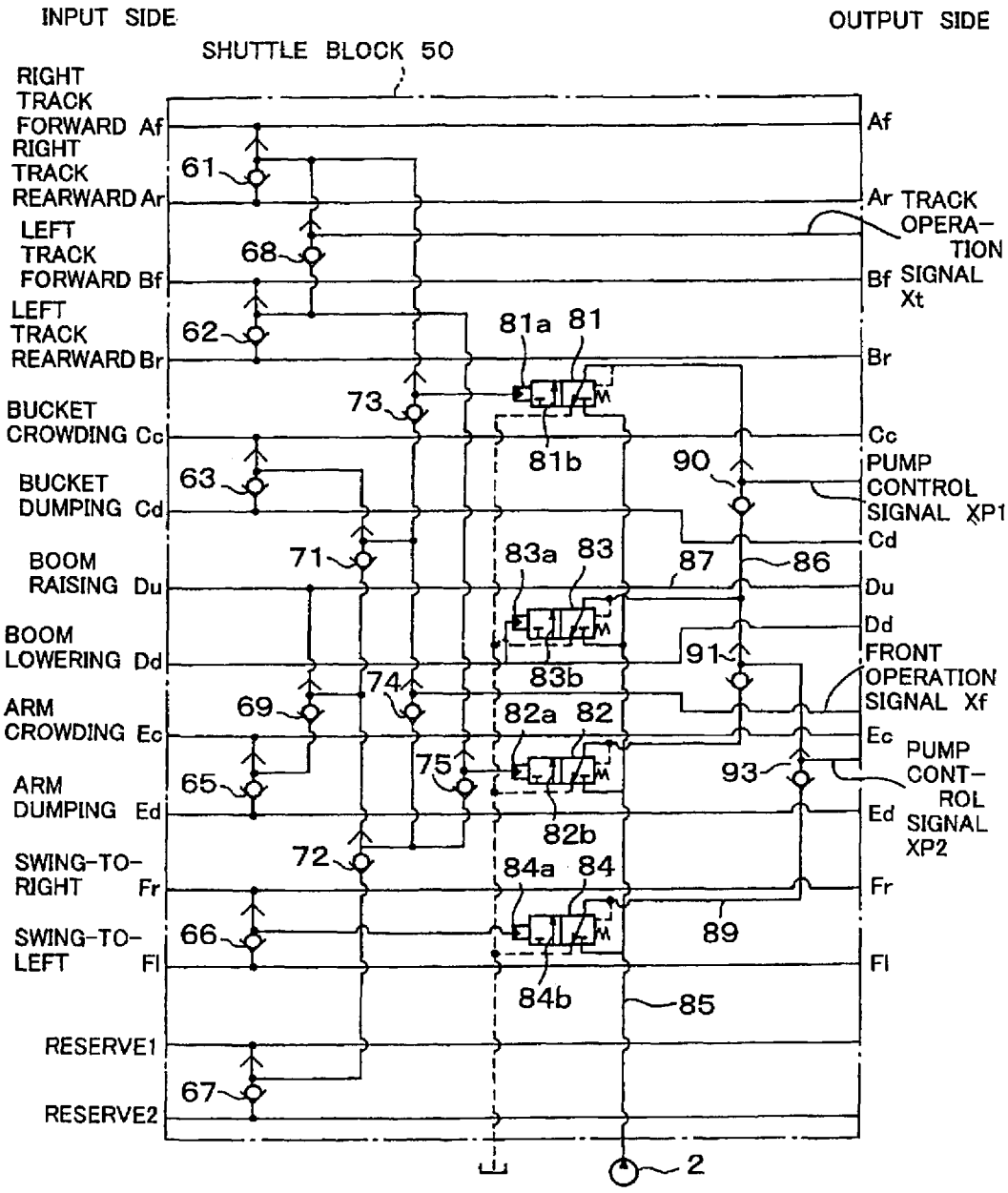
FIG. 9 is a hydraulic circuit diagram depicting a shuttle block which constitutes an essential part of a third embodiment of the present invention.

FIG. 9 is the hydraulic circuit diagram depicting the shuttle block which constitutes the essential part of the third embodiment of the present invention.

This third embodiment is a combination of the above-described first embodiment and second embodiment.

Specifically, a shuttle block 50 is internally provided with a boom-lowering, hydraulic selector valve 83 and a superstructure-swinging, hydraulic selector valve 84 in addition to a hydraulic selector valve 81 and a hydraulic selector valve 82. The boom-lowering, hydraulic selector valve 83 is changed over by the boom-lowering, operation signal pressure Dd, the superstructure-swinging, hydraulic selector valve 84 is changed over by the operation signal pressure Fr or F1 selected by the shuttle valve 66 and relating to swinging, the hydraulic selector valve 81 is changed over by a higher pressure selected by a shuttle valve 73, and the hydraulic selector valve 82 is changed over by a higher pressure selected by a shuttle valve 75. In a downstream stage of the shuttle valve 91, there is disposed a shuttle valve 93 which selects the higher one of the pressure selected by the shuttle valve 91 and the superstructure-swinging control signal pressure produced by the superstructure-swinging, hydraulic selector valve 84 and outputs it as a pump control signal XP2.

The external dimensions of the above-mentioned hydraulic selector valves 81,82, boom-lowering hydraulic selector valve 83 and superstructure-swinging, hydraulic selector valve 84, including their springs, are set equal, for example. However, the cross-sectional area of a line 83*b* in the boom-lowering, hydraulic selector valve 83 communicating the line 85, which is in communication with the pilot pump 2, and a line 87, which is in communication with a line 86 between the shuttle valves 90 and 91, with each other is set smaller beforehand compared with the cross-sectional areas of the lines 81*b*,82*b* in the hydraulic selector valves 81,82. Further, the cross-sectional area of a line 84*b* communicating a line 85, which is in communication with the pilot pump 2, and a line 89, which is in communication with the shuttle valve 93, with each other set smaller beforehand compared with the cross-sectional areas of the flow lines 81*b*,82*b* in the hydraulic change-over valves 81,82.

As illustrated in FIG. 6, owing to this setting, the characteristics of the boom-lowering, hydraulic selector valve 83 and the characteristics of the superstructure-swinging, hydraulic selector valve 84 are represented by characteristics S2 which have been parallelly shifted downwards relative to characteristics S1 of the pump control signals XP1,XP2 outputted from the hydraulic selector valves 81,82.

The remaining construction is similar to that of the above-described first embodiment.

In the third embodiment constructed as described above, describing, for example, about operations of the pump regulators 28*a*,28*b*, a control signal pressure produced at the hydraulic selector valve 81 is outputted as a pump control signal pressure XP1 to a signal line 52 through a shuttle valve 90 and is applied to the pump regulator 28*a* in each of the operations other than the single boom-lowering operation and the single superstructure-swinging operation. Further, a control signal pressure produced at the hydraulic changeover valve 82 is outputted as a pump control signal XP2 to a signal line 53 through a shuttle valve 91 and is applied to the pump regulator 28*b*.

By the pump control signal pressures, the pump regulators 28*a*,28*b* control the delivery flow rates from the main hydraulic pumps 1*a*,1*b*. The values of the pump control signals XP1,XP2 at this time are located on the characteristics S1 in FIG. 6 as mentioned above. On the other hand, the values of the flow rates Q of the main hydraulic pumps 1*a*,1*b* controlled by the pump regulators 28*a*,28*b*, respectively, are located on the characteristics K1.

In a single boom-lowering operation, a boom-lowering control signal pressure produced at the boom-lowering, hydraulic selector valve 83 is outputted as pump control signals XP1,XP2 through the shuttle valve 90,91,93, and are applied to the pump regulators 28*a*,28*b*, respectively. As a result, the pump regulators 28*a*,28*b* control the delivery flow rates from the main hydraulic pumps 1*a*,1*b*. The values of the pump control signals XP1,XP2 at this time are located on the characteristics S2 in FIG. 6. Namely, the values of the pump control signal XP1,XP2 at this time are lower compared with the values of pump control values XP1,XP2 during each of the operations other than the single boom-lowering operation and the below-described, single superstructure-swinging operation. Therefore, the values of flow rates Q of the main hydraulic pumps 1*a*,1*b* controlled by the regulators 28*a*,28*b* are located on the characteristics K2 in FIG. 7, and tend to be suppressed compared with the characteristics K1 of the case that the regulators 28*a*,28*b* are controlled by pump control signal XP1,XP2 outputted through the hydraulic selector valves 81,82. As a consequence, a pressure produced at the boom cylinder 20 can be controlled to a suppressed low pressure.

In a single superstructure-swinging operation, a superstructure-swinging control signal pressure produced at the superstructure-swinging, hydraulic selector valve 84 is outputted as a pump control signal XP2 through the shuttle valve 93, and is applied to the pump regulator 18*b*. As a result, the pump regulator 28*b* controls the delivery flow rate from the main hydraulic pump 1*b*. The value of the pump control signal XP2 at this time is located on the characteristics S2 in FIG. 6.

Namely, the value of the pump control signal XP2 at this time is lower compared with the value of the pump control value XP2 during each of the operations other than the above-mentioned, single boom-lowering operation and single superstructure-swinging operation. Therefore, the value of a flow rate Q of the main hydraulic pump 1*b* controlled by the pump regulator 28*b* is located on the characteristics K2 in FIG. 7, and tends to be suppressed compared with the characteristics K1 of the case that the regulator 28*b* is controlled by a pump control signal XP2 outputted through the hydraulic selector valves 81,82. As a consequence, a pressure produced at the swing motor 18 can be controlled to a suppressed low pressure.

As has been described above, the third embodiment permits smooth performance of both of an operation requiring a high pressure, said operation being other than a single boom-lowering operation and a single superstructure-swinging operation, and the single boom-lowering operation or single superstructure-swinging operation desired to produce a pressure at a suppressed level, assures good operability, and can improve the accuracy of various work performed by the hydraulic excavator.

In each of the above-described embodiments, the cross-sectional area of the line 83*b* formed in the boom-lowering, hydraulic selector valve 83 or the cross-sectional area of the line 84*b* formed in the superstructure-swinging, hydraulic selector valve 84 is set smaller beforehand compared with the cross-sectional areas of the flow lines 81*b*,82*b* formed in the hydraulic selector valves 82,82. The present invention is, however, not limited to such a construction.

For example, it is possible to adopt such a construction that the external dimensions of the hydraulic selector valves 81,82, the external dimensions of the boom-lowering, hydraulic selector valve 83 and the external dimensions of the superstructure-swinging, hydraulic selector valve 84, all including the lines 81*b*,82*b*,83*b*,84*b*, are set equal to each other and a spring having stronger spring force than those of springs biasing spools of the hydraulic selector valves 81,82 is arranged on the boom-lowering, hydraulic selector valve 83 or the superstructure-swinging, hydraulic selector valve 84.

The characteristics of pump control signals XP1,XP2 upon a single boom-lowering operation or a single superstructure-swinging operation when constructed as described above become those represented by the characteristics S3 in FIG. 6. Specifically, the inclinations of their characteristics lines become gentler compared with the characteristics S1 of the pump control signals XP1,XP2 corresponding to the control signal pressures produced at the hydraulic selector valves 81,82. As shown by the characteristics K3 in FIG. 7, the values of the flow rates Q of the main hydraulic pumps 1*a*,1*b* tend to be suppressed compared with the characteristics K1 when the regulators 28*a*,28*b* are controlled by the pump control signals XP1,XP2 corresponding to the control signal pressures produced at the hydraulic selector valves 81,82. As a consequence, a pressure to be produced at the boom cylinder 20 or the swing motor 18 can also be controlled to a suppressed low pressure.

Similarly to the above-described individual embodiments, the construction which takes into consideration the force of the spring biasing the spool of the boom-lowering, hydraulic selector valve 83 or the superstructure-swinging, hydraulic selector valve 84 as described above also permits smooth performance of both of an operation requiring a high pressure, said operation being other than a single boom-lowering operation and a single superstructure-swinging operation, and the single boom-lowering operation or single superstructure-swinging operation desired to produce a pressure at a suppressed level, assures good operability, and can improve the accuracy of various work performed by the hydraulic excavator.

INDUSTRIAL APPLICABILITY

According to the present invention, it is possible to smoothly perform both of an operation requiring a high pressure and an operation desired to produce a pressure at a suppressed level, and further, to improve the accuracy of various work performed by a hydraulic working machine, in which the hydraulic circuit system can be installed, over the conventional art.

The invention claimed is:

1. A hydraulic circuit system for a hydraulic working machine, said hydraulic circuit system comprising:

at least one hydraulic pump, plural actuators driven by a hydraulic fluid delivered from said hydraulic pump, plural flow control valves for feeding the hydraulic fluid, which has been delivered from said hydraulic pump, to said plural actuators, respectively, a pilot hydraulic pressure source, plural pilot operating units for producing operation signal pressures from said pilot hydraulic pressure source to change over the corresponding flow control valves, shuttle valves for selecting maximum pressures from plural groups of operation signal pressures among the operation signal pressures produced by said plural pilot operating units, a hydraulic selector valve arranged in association with at least one of said plural operation signal pressure groups and operated based on said maximum pressure to produce a corresponding control signal pressure from the pressure of the pilot pressure source, and a shuttle block with all of said shuttle valves and hydraulic selector valve built therein such that said control signal pressures are produced in said shuttle block to operate at least one control device arranged in association with any one of said hydraulic pump, said actuators and said flow control valves, wherein in addition to said hydraulic selector valve operated based on said maximum pressure, at least one of a boom-lowering, hydraulic selector valve, which is operated based on an operation signal pressure relating to a single boom-lowering operation among said operation signal pressures produced by said pilot operating units, and a superstructure-swinging, hydraulic selector valve, which is operated based on an operation signal pressure relating to a swing revolving operation to produce a swing control signal pressure from the pressure of said pilot pressure source, is built in said shuttle block, wherein said control signal pressures produced from said boom-lowering, hydraulic selector valve and superstructure-swinging, hydraulic selector valves comprise a pressure signal for operating said control device arranged in association with said hydraulic pump, and wherein with respect to equal operation signal pressures from said pilot operating units, a delivery flow rate from said hydraulic pump based on control signal pressures produced from said boom-lowering selector valve and superstructure-swinging, hydraulic selector valves are smaller than a delivery flow rate from said hydraulic pump based on a control signal pressure produced from another hydraulic selector valve for operating said control device arranged in association with said pump.

* * * * *